United States Patent [19]

Shibata et al.

[11] 4,136,274

[45] Jan. 23, 1979

[54] THERMAL HEAD FOR A PRINTER

[75] Inventors: Susumu Shibata; Tsutomu Nomoto; Keiji Murasugi, all of Tokyo, Japan

[73] Assignee: Oki Electric Industry Co., Ltd., Tokyo, Japan

[21] Appl. No.: 784,848

[22] Filed: Apr. 5, 1977

[30] Foreign Application Priority Data

Apr. 5, 1976 [JP] Japan ..... 51-37229
Aug. 30, 1976 [JP] Japan ..... 51-102586

[51] Int. Cl.[2] ..... H05B 1/00
[52] U.S. Cl. ..... 219/216; 219/543; 338/287; 338/308; 346/76 R
[58] Field of Search ..... 219/216, 388 W, 543; 346/76 R; 338/307-309, 287, 283; 427/96, 102, 103, 123, 125, 126; 357/28; 29/611, 620, 621

[56] References Cited

U.S. PATENT DOCUMENTS 3,684,858 8/1972 Buck ..... 219/216
3,984,809 10/1976 Dertouzos et al. ..... 346/76 R

*Primary Examiner*—C. L. Albritton
*Attorney, Agent, or Firm*—Armstrong, Nikaido, Marmelstein & Kubovcik

[57] ABSTRACT

A thermal head for a thermal printer having a dielectric support and a plurality of conductive layers made of a single material has been found. Said conductive layer comprises a pair of lead lines at both the extreme ends of the same and a heater line formed in a zigzag fashion between said lead lines, and the material of the conductive layer is, for instance, nickel. A portion of said lead line is plated with a conductive material whose conductivity is better than that of the heater. Said heater line is covered with single protection layer of $Al_2O_3$.

14 Claims, 9 Drawing Figures

THERMAL HEAD FOR A PRINTER

BACKGROUND OF THE INVENTION

The present invention relates to an improvement in a thermal head for a thermal printer.

With the advent of computer technology and advances in the arts of data processing and/or data communication, requirements for increased speed of information handling have become more stringent. One known type of rapid printing is a high speed thermal printer, which has at least a thermal head and a printing paper, and operates on the principle that a thermal head, heated to a high temperature according to the pattern of a desired character to be printed, selectively changes the color of a thermal paper. A thermal printer has the advantage that it can print not only a predetermined pattern of characters, but also any pattern desired including pictures, Chinese characters and/or Arabian characters.

A thermal printer is a kind of a dot printer which composes the pattern to be printed with a plurality of dots, and a thermal head has a plurality of heat cells arranged, for instance, in a straight line for printing these dots. As the thermal paper moves in a direction perpendicular to said straight line of heat cells; said heat cells are selectively heated, thus the color of the thermal paper is selectively changed. Thus the desired pattern is printed on the thermal paper.

Some prior thermal heads are U.S. application Ser. No. 672,131 (filed Oct. 2, 1967), and U.S. Pat. No. 3,598,956. First, the features of those prior arts will be explained.

FIG. 1 shows a plane view of the main body of a prior thermal head. In the figure, the reference numeral 10 is a dielectric support, 11 through 18 are square heaters, 21 through 28 are lead lines each of which is connected to its corresponding heater and 30 is a common lead line connected to all of the heaters 11–18. The heaters 11–18 are a thin film of $Ta_2N$, NiCr, Ta or cermets, and the lead lines 21–28 are conductive layer made of Au, Ag or Cu. On the heater and the vicinity of the same, a pair of layers (not shown) for preventing the oxidation of the heater and for preventing the wear of the heater due to friction with the thermal paper are provided. Usually, said pair of layers are laminated in thin films on the heaters. Those layers are called protection layers.

FIG. 2 is a plane view of the main body of another prior thermal head. In the figure, the reference numerals 111, 112 and 113 are heaters made of $Ta_2N$, NiCr or Ta, all three of which operate to print a single dot. 121, 122 and 123 are also heaters and operate to print a single dot. Also the groups (131, 132, 133), (141, 142, 143), (151, 152, 153) and (161, 162, 163) are heaters and each group operates to print a single dot. The reference numerals 21 through 26, and 41 through 46 are lead lines each of which is connected to its corresponding heater for applying the electric power to the heater. 511, 512, 521, 522, - - - , 562 are conductors connecting the heater lines, and 611, 612, 621, 622, - - - , 662 are electrodes connecting the heaters and the lead lines. The protection layers are not shown in FIG. 2 for the sake of simplicity. The thermal paper moves in the direction of the arrow A in FIGS. 1 and 2.

FIG. 3 is a cross-sectional view at a-a' in FIG. 1, which also shows the protection layers 61 and 62. The protection layer 61 is for preventing the oxidation of the heaters and the protection layer 62 is for reducing the wear of the heaters due to friction with the thermal paper. The reference numeral 7 is thermal paper and 8 is a roller for moving the thermal paper 7 and pushing the thermal paper 7 into contact with the heaters.

However, the prior thermal heads in FIGS. 1 and 2 have the disadvantages described below due to the structures explained regarding FIGS. 1, 2 and 3.

(1) In manufacturing a thermal head the accurate positioning of a mask for a photo-etching process is necessary. First, the lead lines 21–28 and the common lead line 30 are manufactured through a photo-etching process, and next the heaters 11–18 are manufactured through an etching process. Accordingly, at least two etching processes are necessary, and the second process requires accurate mask positioning in relation to the first process. The requirement accurate positioning reduces the yield rate. The structure in FIG. 2 requires even more accuracy in the positioning of the mask, and further, it is very difficult to manufacture the heaters 111, 112, 113, 121, 122, - - - , 163, since those heaters are very thick.

(2) The life time of the prior thermal heads is short.

Generally speaking, the preferable resistance of a heater is in the range of 50 Ω to 300 Ω. If the resistance of a heater is lower or higher than that value, the electric current or the electric voltage reguired for generating the temperature for printing becomes too high, thus the external circuitry becomes complicated.

When the square heater in FIG. 1 is made of $Ta_2N$ or NiCr the thickness of the heater for obtaining the above preferable resistance is only about 500 Å, however, that thickness is not sufficient to provide the desirable long life. Further, the heater in FIG. 2 must be very thick in order to obtain said desirable resistance when the prior heater material is utilized, since the heater is folded and the total length of the same is rather long. According to the experiment, the thick film in FIG. 2 is rather difficult to make, and the film cannot be attached securely to the support, therefore, the yield rate is low.

(3) A prior thermal head has a cutaway portion at the contact area of the heater with thermal paper, and has steps S and S' as shown in FIG. 3, due to the difference of thickness and/or material between the heater 30, etc., and the lead line 23, 30, etc. Said cutaway causes the contact of the head with thermal paper to be incomplete, increasing the necessary power consumption since the thermal conductivity from the heater to paper is lessened, and the life time of the head is shortened since the heater must be over-energized due to incomplete contact. Further the dust from the paper is apt to be collected in the cutaway portion. The above situations are the same as those in FIG. 2.

SUMMARY OF THE INVENTION

It is an object, therefore, of the present invention to overcome the disadvantages and limitations of the prior thermal heads by providing a new and improved thermal head.

The above and other objects are attained by a thermal head comprising a dielectric plane support, a plurality of first conductive layers of a single material attached parallel to one another on said support, each of which being electrically insulated to one another, each of said conductive layers having a pair of straight lead lines at both the extreme ends of the same and a heater line formed in a zigzag fashion between said lead lines, a second conductive layer plated on part of said lead lines, the conductivity of the material of said second conductive layer being better than that of said first conductive layer, and the material of said first conductive layer is Ni, Cr, Al, Pt, W, Mo or Ti.

BRIEF EXPLANATION OF THE DRAWINGS

The foregoing and other objects, features, and attendant advantages of the present invention will be appreciated as the same become better understood by means of the following description and accompanying drawings; wherein.

DESCRIPTION OF THE PREFERRED EMBODIMENTS

Figure 4:
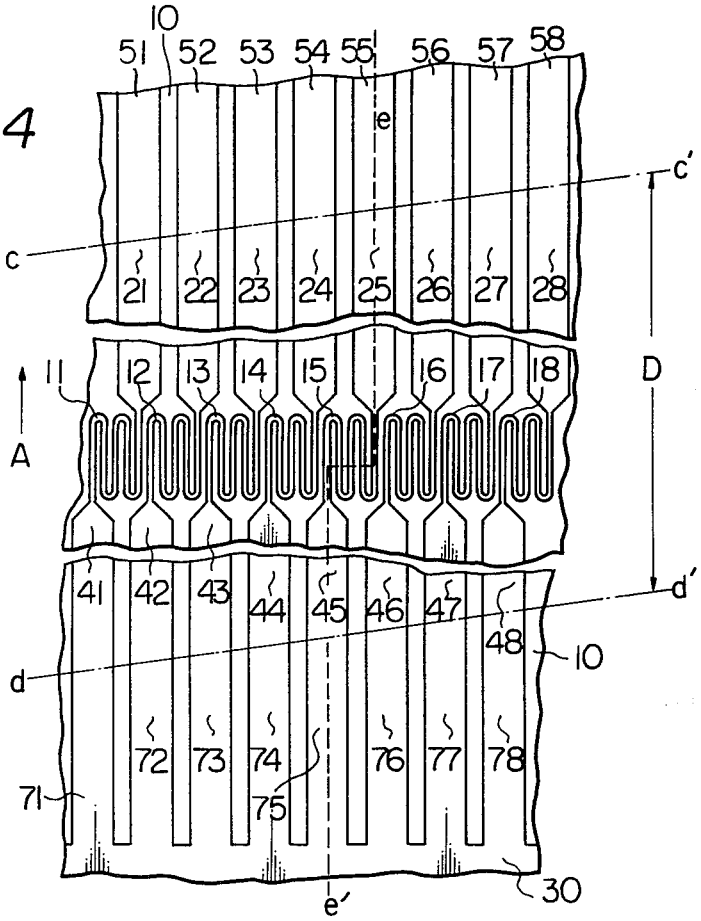
FIG. 4 is a plane view of the main body of the thermal head according to the present invention.

FIG. 4 shows the plane view of the main body of the present thermal head. In the figure, the reference numeral 10 is a dielectric support, 11 through 18 are heaters positioned in a zigzag line. Said heaters are made of an electrically conductive film such as Ni (Nickel), Al (Aluminum), Cr (Chrome), Ti (Titanium), Mo (Molybdenum), W (Tungsten), or Pt (Platinum). 21 through 28 and 41 through 48 are lead lines for supplying electric current to the heaters 11 through 18, and are made of the same material as that of the heaters. Those lead lines are connected to the end of the heaters which are formed in a zigzag line.

The heaters 11 through 18 are formed in a zigzag line and the width of the same is smaller than that of lead lines 21–28 and 41–48 so that each heater has more electrical resistance than its corresponding lead line. 51 through 58 are conductive layers plated on the lead lines 21 through 28, and are made of Au (Gold), Ag (Silver), or Cu (Copper). 71 through 78 are also conductive layers plated on the lead lines 41 through 48, and are made of Au, Ag or Cu.

Figure 1:
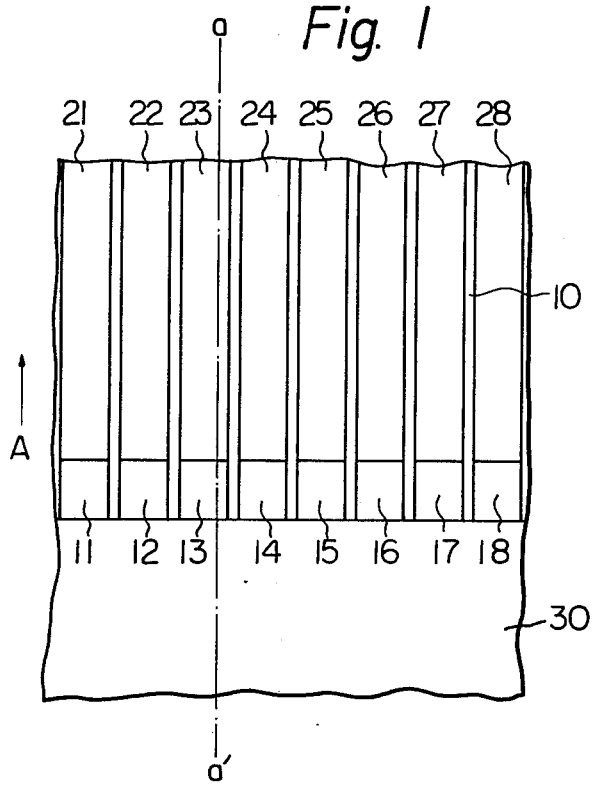
FIG. 1 is a plane view of the main body of a prior thermal head.
Figure 2:
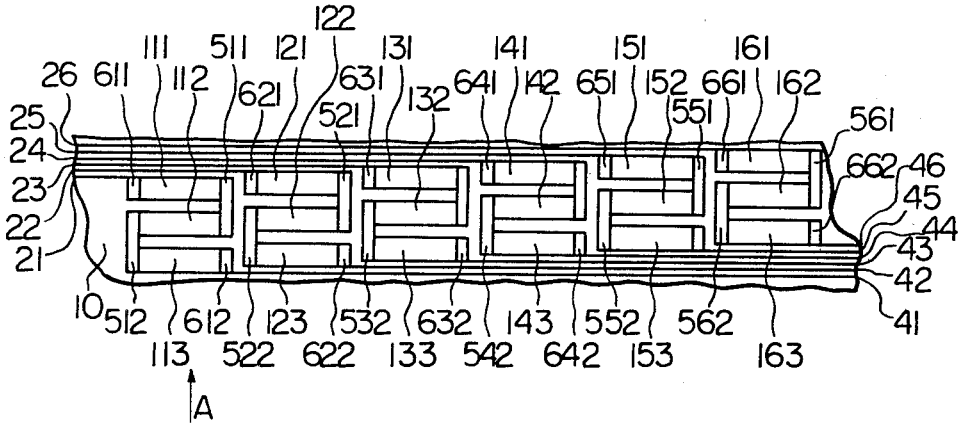
FIG. 2 is a plane view of the main body of another prior thermal head.

It should be appreciated that the material of the heaters 11–18 is the same as that of lead lines 21–28 and 41–48, and as a result of the above structure, the manufacturing steps are considerably reduced and the necessity for accurate alignment of etching masks is eliminated. Since the heaters 11–18, lead lines 21–28 and 41–48, and a common lead line 30 are made of a single material, a single etching after said material is attached to the dielectric support can provide the heater assembly. Further, in order to facilitate the plating of Au, Ag or Cu near the heaters 11–18 so as to reduce the electrical resistance of the lead lines, the heater assembly has the following structure. The width of the lead lines 21–28 including portions 51–58 on one side of the heaters 11–18 is the same as the width of the lead lines 41–48 including portions 71–78 on the other side of the heaters 11–18, further, the length D between line C—C' and line d—d' is constant for each lead line. Said length D is equal to the width of the mask which prevents the plating of Au, Ag or Cu on the inner portion of the lead lines 21–28 and 41–48 and the heaters 11–18. Accordingly, the electrical resistance of the pair of lead lines 21 and 41 is the same as that of 22 and 42, and in turn 23 and 43, 24 and 44, through 28 and 48, and thus, the power consumption is unifarm in each heater 11 through 18. Therefore, we can obtain uniform printing intensity on the thermal paper. According to the particular structure shown in FIG. 4, the accurate and complicated etching mask required in the prior art in FIGS. 1 and 2 is not necessary, and all that is required for the mask in FIG. 4 is that the width D, which prohibits the plating Au, Ag or Cu, is uniform, further, a microscope for positioning the mask is not necessary. Since the length D is usually 3 mm - 5 mm, and the length of the heaters in the direction of paper movement is only 200 μm, the mask alignment according to the present invention is simple while the mask alignment of the prior art which covers only the small heater portion is rather difficult.

Additional information regarding each individual conductive material is given below.

(1) When the heaters 11–18 are made of Ni or Pt;

The manufacturing process of a heater assembly is as follows. First, the material (Ni and Pt) is attached to the dielectric support or substrate, and next heater portions 11–18, lead line portions 21–28 and 41–48, portions for plating 51–58, 71–78 and 30 are formed by a single photo-etching process. Next, a resist is attached to the portion between lines c-c' and d-d' in FIG. 4 by photo-resist process and Au, Ag or Cu is plated on the entire plane. Next, said resist between c-c' and d-d' is removed, and a protection layer (not shown) is attached to the heater portion.

(2) When the heaters 11–18 are made of W, Cr, Al, Mo, or Ti;

Two manufacturing methods are possible.

(a) After one of said materials is attached to the dielectric support, a thin nickel layer is plated on said material. Next, a resist in the form of heater portions 11–18, lead lines 21–28 and 41–48, plating portions 51–58 and 71–78, and common lead line portion 30 is attached to said nickel layer by a photo-resist process. The nickel and the heater material which are not covered by said resist are removed by a nickel etching solution and a heater etching solution, thus the pattern of the heaters and the lead lines is obtained. Next, Au, Ag or Cu is plated in the same manner as described in section (1). Next the resist between the lines c-c' and d-d' in FIG. 4 is removed, and also the nickel layer in that portion is removed. Finally, a protection layer is attached on the heater portion.

(b) After one of the materials is attached to the dielectric support, a very thin conductive layer of Au, Ag or Cu is plated on the entire plane. A resist forming the heater portions 11–18, lead line portions 21–28 and 41–48, plating portions 51–58 and 71–78, and common lead line portion 30 is attached to said thin conductive layer by a photo-resist process. Said thin conductive layer and the heater material which are not covered by said resist are removed by an etching solution, thus the pattern of the heaters and the lead lines is obtained. Next, Au, Ag or Cu is plated on the outer lead line portions in the same manner as described in section (1). Next, the resist between the lines c-c' and d-d' in FIG. 4 is removed and also the conductive layer on that portion is removed. Finally, a protection layer is attached to the heater portion.

As described above, the pattern of the heater portion and the lead line portion is manufactured by a single photoetching process, and no accurate positioning of masks is necessary.

The heater according to the present invention is in the form of a zigzag line as shown in FIG. 4. The following experiments are performed for the purpose of determining the best parameters for a zigzag heater. In the experiments, the dielectric support is glazed-alumina, and the material of heater and lead line is nickel which has a sheet resistivity 1 Ω/□

Experiment (1)

Figure 5:
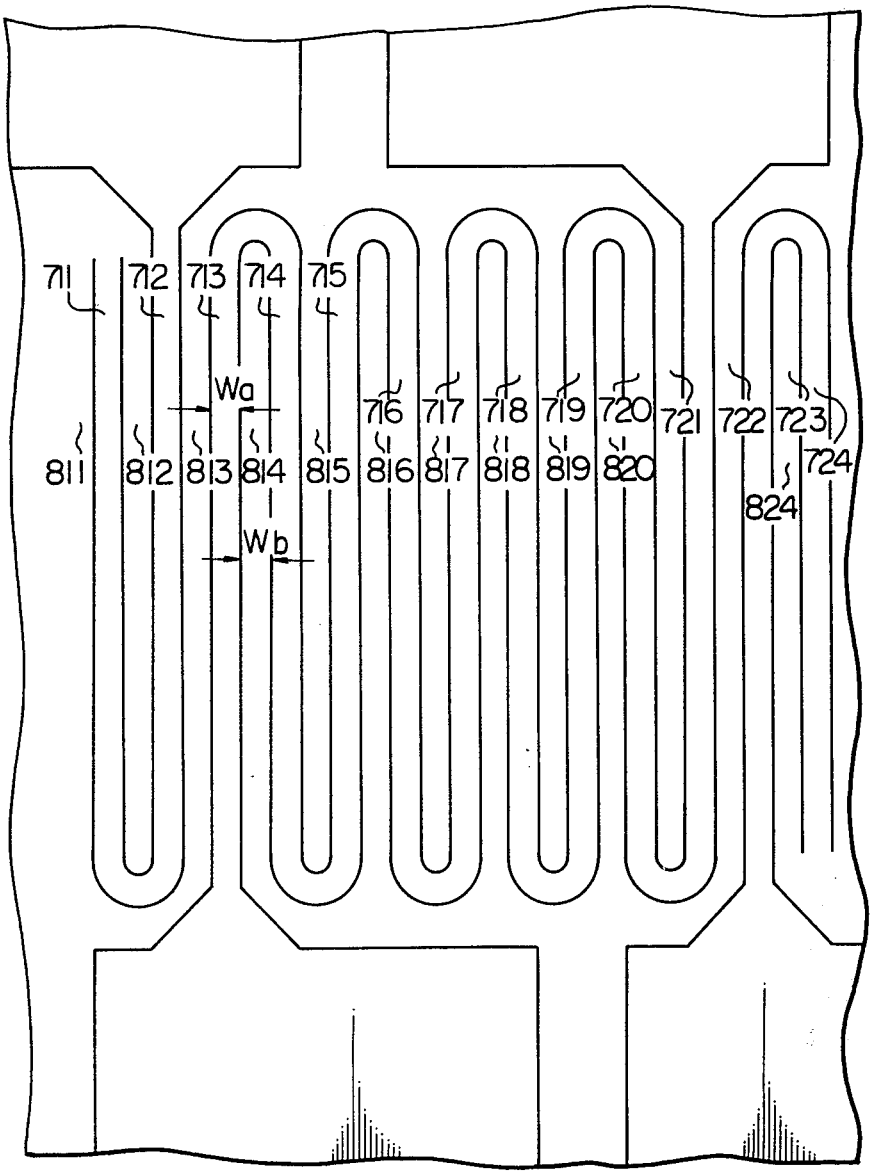
FIG. 5 is a plane view of the main body of the heater of the thermal head according to the present invention, showing the optimum width and duration of heater lines.

FIG. 5 shows an enlarged plane view of heaters connected in series with one another. In the figure, the reference numerals 711 through 724 show a heater line having the width Wa, and 811 through 824 show the width of the space between each heater line. The width of the space is Wb. An electric current is applied to the heater line so that a predetermined printing intensity (for instance printing visibility D = 0.8) is obtained, and the life of the heater until a heater line is burn out is measured for each value of Wa, on the condition $Wa = Wb$. A part of the result is shown in the Table 1, where the applied pulse width is 3 msec. and the pulse period is 20 msec.

Table 1

| Wa | Life |
|---|---|
| 10 μm | 4 hours |
| 13 μm | 7 hours |
| 19 μm | 1600 hours |
| 31 μm | 100 hours |

According to the results of the experiment, the preferable width of a heater line is 20 μm ± 5 μm.

Experiment (2)

A life test similar to the experiment (1) is performed for each ratio Wa/Wb. A part of the result is shown in the table 2, where the sum of Wa and Wb is 38 μm, pulse width is 3 msec and pulse period is 20 msec.

Table 2

| Wa | Wb | Life |
|---|---|---|
| 3 : 7 | (Wa = 12 μm) | 1 hour |
| 4 : 6 | (Wa = 15 μm) | 6 hours |
| 5 : 5 | (Wa = 19 μm) | 1600 hours |
| 7 : 3 | (Wa = 26 μm) | 1300 hours |

According to table 2, the preferable ratio is approximately 1:1.

Experiment (3), (Step-stress test)

Figure 6:
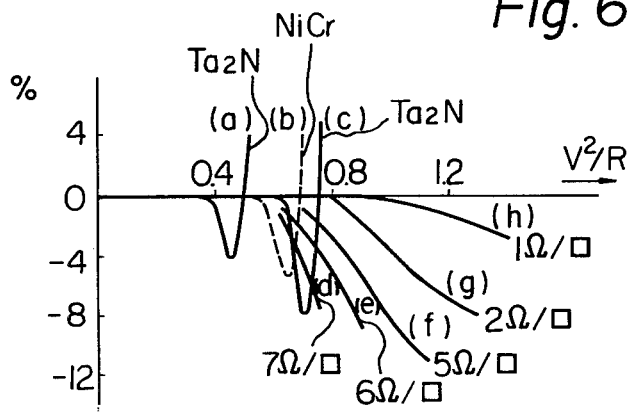
FIG. 6 is a curve showing the result of the step-stress test wherein the heater is made of Ni, $Ta_2N$ or NiCr.

FIG. 6 shows the results of a step-stress test of a heater line, wherein the horizontal axis shows the applied power in $V^2/R$ (where R is the resistance of the heater, V is the amplitude of the pulse the width and the period of which are 6 msec and 20 msec, respectively), the vertical axis shows the variation of the resistance in percent after thirty minutes of test, the heater material is nickel, and the parameter is the sheet resistivity of nickel. In FIG. 6, both the width of a heater line and the space between each heater lines are 20 μm. The curve (a) in FIG. 6 shows the results of the heater of the structure as in FIG. 2 and the heater material is $Ta_2N$, the curve (b) shows the result of the heater of the structure as in FIG. 1 and the heater material is NiCr, and the curve (c) shows the result of the heater of the structure as in FIG. 1 and the heater material is $Ta_2N$. The curves (d) through (h) show the result of the heater of the structure in FIG. 4 for each sheet resistivity, that is to say, the curves (d), (e), (f), (g) and (h) correspond to the sheet resistivity 7, 6, 5, 2 and 1 Ω/□, respectively. As apparent from FIG. 6, the smaller sheet resistivity provides the better step-stress characteristics and smallest variation in resistance. The smaller variation in resistance is preferable since the printed intensity depends upon the value of this resistance. The better step-stress characteristic is also preferable in a printing heater since the same provides better results in an over-load test. On the other hand, too small sheet resistivity is not preferable since small sheet resistivity results in small heater resistance and large power consumption for a required printing intensity. For instance, if the sheet resistivity is 0.1 Ω/□, more than 500 mA of current is necessary for each dot when the width of a heater is 20 μm, therefore a large external circuit would be required. Further, too large sheet resistivity is not preferable, since the step-stress characteristics becomes worse than that of the prior art when the sheet resistivity is more than 7 Ω/□ as shown in FIG. 6, so sheet resistivity should be less than 6 Ω/□. Accordingly, the preferable sheet resistivity of nickel is from 0.1 Ω/□ to 6 Ω/□.

Although the above tests results are based on the use of nickel as the heater material, the experiment showed that other materials like W, Mo, Al, Cr, Ti or Pt can be used as a heater. For instance, in the life test for printable power consumption, Al showed the longer life by 20% than Ni.

That is to say, in the experiment where material is Ni of sheet resistivity 2 Ω/□ with protection layer of $SiO_2$ with thickness 2 μm, and the applied pulse has the pulse width 6 msec and the pulse period 20 msec, the power consumption when the heater is burned out is 53 $(V^2/R)/mm^2$, where V is the amplitude of the applied pulse and R is the resistance of the heater. While when the material is Al of sheet resistivity 0.3 Ω/□ with protection layer of $SiO_2$ with thickness 2 μm, the power consumption when the heater is burned out is 65 $(V^2/R)/mm^2$. The higher the power consumption when the heater is burned out is, the longer the life time of the heater is.

Further, Cr showed the excellent property in life test, in which the electric power enough to obtain the intensity D = 0.7 of pulse period 20 msec, is applied, and the number of the applied pulses until the heater is burned out is counted. The result is shown in the table below.

| Pulse Width | Material | Number of Pulses |
|---|---|---|
| | Ni 1 Ω/□ | $1.8 \times 10^5$ |
| 1 msec | Cr 2.7 Ω | |
| □ | $7.5 \times 10^6$ | |
| | Cr 6 Ω/□ | $1 \times 10^8$ |
| | Ni 1 Ω/□ | $1 \times 10^7$ |
| 1.5 msec | | |
| | Cr 2.7 Ω/□ | $1 \times 10^8$ |

Figure 7:
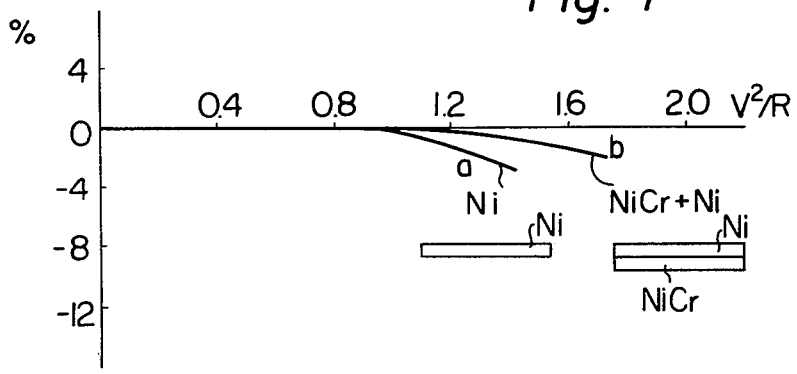
FIG. 7 is a curve showing the result of the step-stress test wherein the heater has a support layer made of NiCr and a heater layer made of Ni formed on the support layer.

Another materials including W, Mo, Ti, Pt, the melting point of which is high and can be attached tightly on the support, showed similar results to those described above for Ni, FIG. 7 shows the curve of another step-stress test in which the heater is formed on a foundation layer. In FIG. 7, the horizontal axis shows the power consumption in $V^2/R$ and the vertical axis shows the variation of the resistance in percent. The curve (a) in FIG. 7 shows the results of the step-stress test wherein the heater is made of only nickel, and the curve (b) shows the results of the step-stress test wherein the heater has a fundation layer of NiCr under the nickel layer. It should be noted that too thick a foundation layer is not desirable since the Cr will diffuse into the nickel layer and increase the resistance of the heater, Cr can also be used as a foundation layer instead of NiCr. Concerning the thickness of the foundation layer, the preferable thickness in the case of NiCr is such that the sheet resistivity is in the range of 200 Ω/□ to 600 Ω/□. As apparent from FIG. 7, the presence of the foundation layer improves the step-stress characteristics and prevents the deterioration of the heater material. Further, the foundation layer provides a stronger connection between the heater material and the dielectric support. Thus, a small quantity of Cr in the Ni improves the heater.

Experiment (4) (Protection layer)

Figure 3:
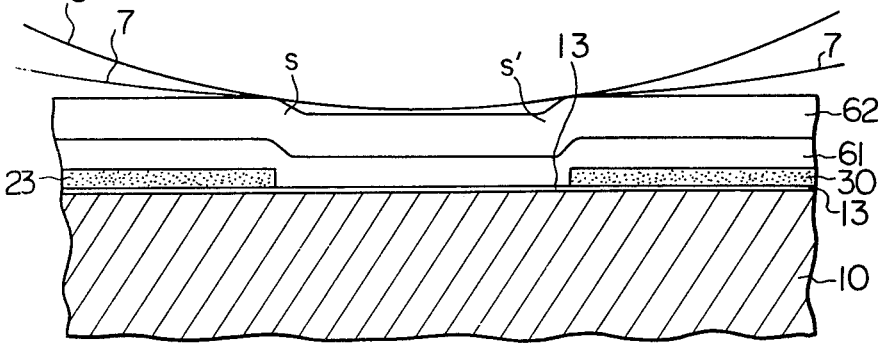
FIG. 3 is a cross sectional view at a-a' of FIG. 1.

As explained in FIG. 3, the reference numeral 61 is a layer for the protection of the heater, and 62 is a layer for preventing the wear of a heater due to friction with the printing paper. The materials for the above layers 61 and 62 are usually $SiO_2$ and $Ta_2O_5$, respectively, when the heater material is nickel (Ni). Although the prior thermal head has two protection layers 61 and 62, the present thermal head requires only a single protection layer. The following is the experimental results concerning the protection layer.

(a) When the protection layer is SiC;

It has been proved that a layer of SiC cannot be securely connected to the heater material, so SiC is not good as a protection layer material.

(b) When the protection layer is $Ta_2O_5$;

$Ta_2O_5$ is very inefficient as a protection layer material. As shown in the curve (a) in FIG. 8, a protection layer of $Ta_2O_5$ is destroyed by more than $1.0(V^2/R)$ of applied electric power, which is the minimum necessary for printing.

(c) When the protection layer is $SiO_2$;

$SiO_2$ will not bond properly with the heater material Ni, and sometimes peels off.

Figure 8:
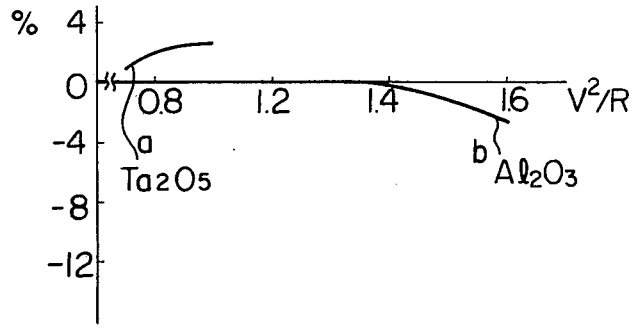
FIG. 8 is a curve showing the result of the step stress test wherein the protection layer on the heater is $Ta_2O_5$ or $Al_2O_3$.

(d) When the protection layer is $Al_2O_3$;

$Al_2O_3$ is excellent as a protection layer material as shown in the curve (b) in FIG. 8. According to the experimental life test under actual printing conditions, the loss in thickness is less than 0.1 μm after printing more than of 10 Km in length of thermal printing paper. Accordingly, the combination of Ni as heater material and $Al_2O_3$ as protection layer material is the best for a thermal head.

The following is a explanation of the temperature distribution in a thermal head. In a thermal head of the structure as shown in FIG. 1, the temperature of the centre portion of the heater is higher than the peripheral or end portions of the heater. Therefore, in order that the length of each dot of a printed character is almost the same as the longitudinal length of a thermal head, the centre portion of said thermal head may reach a higher temperature than required, and as a result the life time of the heaters is shortened.

On the contrary, in the present thermal head of the structure as shown in FIG. 4, uniform temperature distribution is obtained since the heater is in the form of narrow line. Uniform temperature distribution not only affects the life time of the head, but also the printing quality. That is to say, in the prior thermal head shown in FIG. 1, if the thermal head is controlled so that the peripheral area of the head provides enough intensity, the centre portion of the printed characters is printed in too high an intensity. The present thermal head of course provides uniform intensity. Further, in the present thermal head, the printed characters can be formed in continuous lines without any un-colored areas between adjacent dots by designing the space between each heater line in a single character to be equal to the length between the ends of a pair of adjacent characters.

Figure 9:
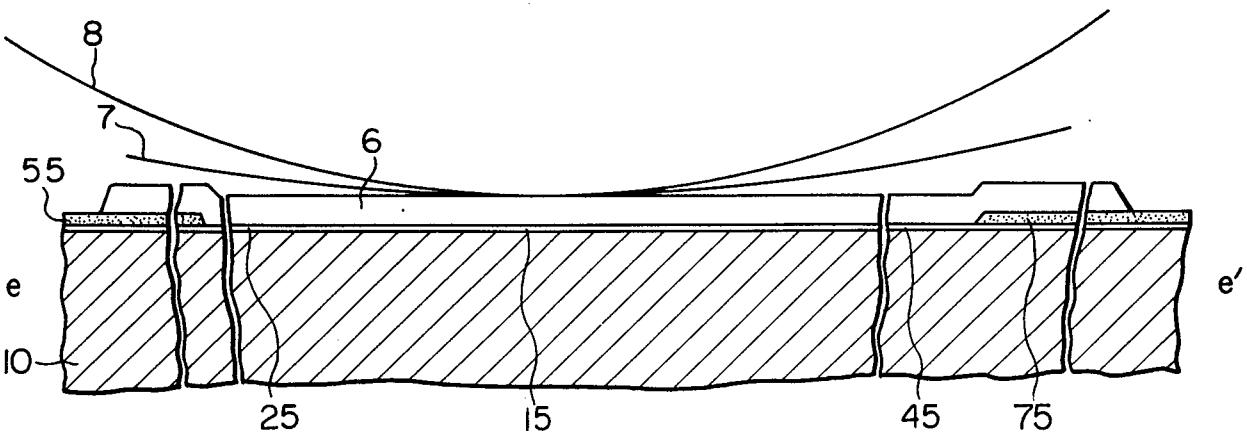
FIG. 9 is a cross-sectional view at e-e' in FIG. 4, and shows the printing situation.

FIG. 9 shows that in the present thermal head the thermal paper touch with contacts the thermal head better than in the prior art. FIG. 9 is a cross-sectional view at line e-e' in FIG. 4, and also shows the protection layer 6. Since the heater material is the same as the lead line material in the present thermal head, the contact face of the thermal head is smooth and has no steps or difference in height of the contact area as shown in FIG. 9, while the prior thermal head in FIG. 3 has the steps S and S' in the contact area. With no steps in the contact area, the present thermal head provides better contact between heater and paper, thus the heat efficiency of the head is improved.

Two of the most important effects obtained by the present invention are;

(1) The life time of a thermal head is considerably lengthened, and (2) The number of manufacturing processes is reduced, and the yield rate is increased.

From the foregoing, it will now be apparent that a new and improved thermal head for a printer has been found. It should be understood of course that the embodiments disclosed are merely illustrative and are not intended to limit the scope of the invention. Reference should be made to the appended claims therefore rather than the specification as indicating the scope of the invention.

What is claimed is:

1. A thermal head for a printer comprising a dielectric plane support, a plurality of first conductive layers of a single material mounted parallel to one another on said support, each of said layers being electrically insulated from one another, each of said conductive layers having a unitary structure including a pair of straight lead lines and a heater line formed in a zigzag fashion between said lead lines, said lead lines and said heater line being integral and continuous, a second conductive layer plated on part of said lead lines, the conductivity of the material of said second conductive layer being better than that of said first conductive layer, wherein the material of said first conductive layer is nickel.

2. The invention as defined in claim 1, wherein the width of said heater line is 20 μm ± 5 μm and the space between each heater lines is almost the same as the width of the heater line.

3. The thermal head as defined in claim 1, wherein the sheet resistivity of the first conductive layer is in the range of 0.1 Ω/□ to 6 Ω/□.

4. The thermal head as claimed in claim 1, wherein a third thin layer is provided between the first conductive layer and the dielectric plane support.

5. The thermal head as claimed in claim 4, wherein the material of the third layer is Cr.

6. The thermal head as claimed in claim 4, wherein the material of the third layer is NiCr.

7. The thermal head as claimed in claim 1, wherein the material of the first conductive layer includes a very small amount of Cr.

8. The thermal head as claimed in claim 1, wherein a single protection layer made of $Al_2O_3$ is attached to the heater lines.

9. The invention as claimed in claim 1, wherein a plurality of lead lines at one end of the first conductive layer extends to a common layer made of the same material as the first conductive layer.

10. A thermal head for a printer comprising a dielectric plane support, a plurality of first conductive layers of a single material mounted parallel to one another on said support, each of said layers being electrically insulated from one another, each of said conductive layers having a unitary structure including a pair of straight lead lines and a heater line formed in a zigzag fashion between said lead lines, said lead lines and said heater line being integral and continuous, a second conductive layer plated on part of said lead lines, the conductivity of the material of said second conductive layer being better than that of said first conductive layer, wherein the material of said first conductive layer is selected from the group consisting of Cr, Al, Pt, W, Mo and Ti.

11. The thermal head as defined in claim 1 including a common lead line electrically interconnecting corresponding ones of the lead lines of said pair of lead lines of each of said plurality of first conductive layers.

12. The thermal head as defined in claim 11 wherein said common lead line is integral with said plurality of first conductive layers.

13. The thermal head as defined in claim 10 including a common lead line electrically interconnecting corresponding ones of the lead lines of said pair of lead lines of each of said plurality of first conductive layers.

14. The thermal head as defined in claim 13 wherein said common lead line is integral with said plurality of first conductive layers.

* * * * *